United States Patent [19]

Guerre

[11] 4,338,188

[45] Jul. 6, 1982

[54] COAL CLEANING PROCESS

[75] Inventor: Robert P. Guerre, Seabrook, Tex.

[73] Assignee: Exxon Research & Engineering Co., Florham Park, N.J.

[21] Appl. No.: 57,250

[22] Filed: Jul. 13, 1979

[51] Int. Cl.[3] ..... B03B 7/00

[52] U.S. Cl. ..... 209/2; 209/12; 209/172.5; 241/20

[58] Field of Search ..... 209/12, 155, 156–158, 209/172.5, 211, 2, 3, 133–139 R, 454, 455, 464; 241/20, 24, 77

[56] References Cited

U.S. PATENT DOCUMENTS

| | | | |
|---|---|---|---|
| Re. 11,334 | 5/1893 | Luhrig | 209/2 |
| 2,150,917 | 3/1939 | Foulke | 209/172 |
| 2,151,175 | 3/1939 | Wuensch | 209/172.5 X |
| 2,217,286 | 10/1940 | McNully | 241/77 X |
| 2,422,203 | 6/1947 | McNeil | 209/211 X |
| 2,612,267 | 9/1952 | Vogel | 209/156 X |
| 2,675,966 | 4/1954 | Kihlstedt | 241/77 X |
| 2,754,903 | 7/1956 | Krijgsman | 209/172.5 X |
| 2,842,319 | 7/1958 | Reerink | 209/2 X |
| 2,890,795 | 6/1959 | Dering | 209/12 |
| 3,193,471 | 7/1965 | Holowaty | 209/172.5 X |
| 3,252,769 | 5/1966 | Nagelvoort | 44/1 |
| 3,261,559 | 7/1966 | Yavorsky | 209/158 X |
| 3,908,912 | 9/1975 | Irons | 241/24 X |

FOREIGN PATENT DOCUMENTS

| | | | |
|---|---|---|---|
| 234951 | 4/1957 | Australia | 209/172.5 |
| 1157172 | 11/1963 | Fed. Rep. of Germany | 209/172.5 |
| 322480 | 12/1929 | United Kingdom | 209/2 |
| 486771 | 6/1938 | United Kingdom | 209/172.5 |
| 856636 | 12/1960 | United Kingdom | 209/172.5 |

OTHER PUBLICATIONS

Coal Mining & Processing, Quackenbush et al., "Chem. Comminution: An Improved Route to Clean Coal", *Coal Min. & Processing*, May, 1979.

*Primary Examiner*—Robert Halper
*Attorney, Agent, or Firm*—Yale S. Finkle

[57] ABSTRACT

A size fraction of coal is physically cleaned by separating the coal into a low density fraction containing relatively small amounts of inorganic constituents and a high density fraction containing relatively large amounts of inorganic constituents, crushing the low density fraction to produce smaller particles, separating the smaller particles into a low density fraction and a high density fraction and recovering the low density fraction as clean coal product.

14 Claims, 1 Drawing Figure

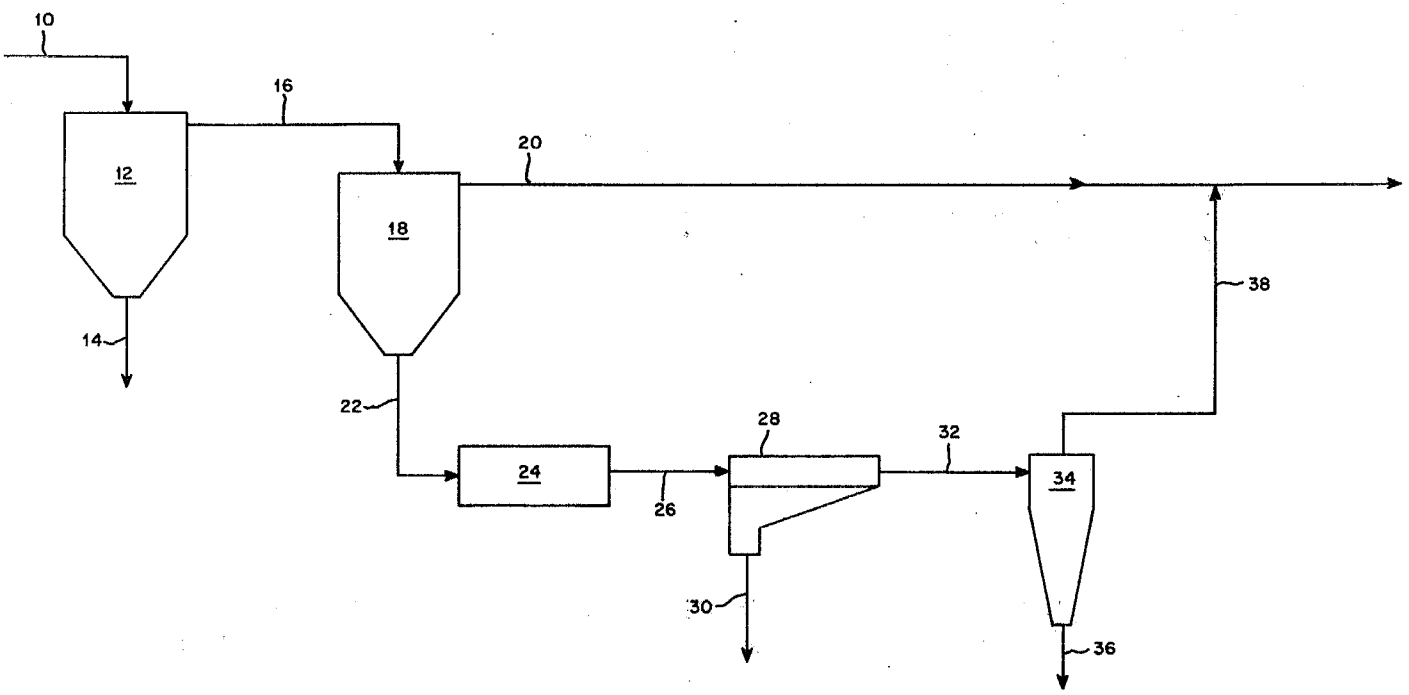
10
12
14
16
18
20
22
24
26
28
30
32
34
36
38

COAL CLEANING PROCESS

BACKGROUND OF THE INVENTION

This invention relates to a process for cleaning coal and similar carbonaceous solids that contain impurities in the form of pyritic sulfur and other ash-forming, inorganic constituents and is particularly concerned with upgrading raw coal by physically removing a substantial portion of these inorganic constituents.

Raw coal contains impurities in the form of inorganic, rock-like constituents which include, among other inorganic compounds, aluminosilicates, iron pyrites, other metal pyrites and small amounts of metal sulfates. Before some coals or similar carbonaceous solids containing these inorganic impurities can be used for fuel, the solids must be cleaned or upgraded to produce carbonaceous solids having a relatively high organic content and a relatively low inorganic content so that when the solids are burned or otherwise utilized they will have a relatively high Btu content, will generate relatively low amounts of sulfur containing pollutants such as sulfur dioxide and will leave relatively small amounts of unwanted ash residue, which is formed by the oxidation of the inorganic constituents during combustion. At the present time federal standards limit sulfur dioxide emissions from coal burning power plants built between 1971 and 1977 to no more than 1.2 pounds of sulfur dioxide per million Btu. A coal which meets this emission standard is commonly referred to as a compliance coal.

The conventional method for physically treating coal for the purpose of removing inorganic sulfur and other inorganic ash-forming constituents normally involves a preliminary step of classifying crushed raw coal into several size fractions: a large size fraction normally containing particles in a size range between about 2 to 6 inches and about 1 to ¼ inch on the U.S. Sieve Series Scale, an intermediate size fraction containing particles normally ranging in size between about 1 to ¼ inch and about 30 mesh on the U.S. Sieve Series Scale, and a small size fraction normally comprised of particles less than about 30 mesh in size. The three different size fractions are then separately treated in equipment specifically designed to handle the particular size fraction. The large and intermediate size fractions are physically cleaned by subjecting the particles to a gravimetric separation which is normally carried out at a specific gravity in the range between about 1.3 and about 1.9 in order to divide the particles into a low density, clean fraction containing a relatively small amount of inorganic constituents and a high density, dirty fraction containing a relatively large amount of inorganic constituents. The particles below about 30 mesh that comprise the small size fraction are so tiny that they take too long to separate by gravity means and therefore froth flotation is the conventional method used for separating these particles into relatively clean and dirty fractions. Gravimetric separations and froth flotation are the conventional methods of washing coal to physically clean it; i.e., to separate the low density, clean fraction from the high density, dirty fraction.

The composition of raw coal varies depending upon the part of the country in which it is mined and the particular portion of the mine from which the coal is taken. Because of the wide variance in the original composition of raw coal, the conventional method of cleaning by crushing the coal and then washing the various size fractions to separate the low density, clean particles from the higher density dirty particles will produce a clean coal of widely varying composition. Thus, in some cases the low density fraction produced from the physical washing of the coal will contain relatively large amounts of inorganic sulfur constituents and will not satisfy the federal sulfur dioxide emission standards for a compliance coal and therefore cannot be directly burned in power plants built between 1971 and 1977 that do not utilize expensive effluent scrubbing equipment. It is normally possible to remove a greater amount of the inorganic impurities and produce a cleaner product by crushing the raw coal to a finer size prior to washing. Such a procedure, however, may still not produce a clean enough low density fraction and to further liberate enough of the inorganic impurities may require grinding or crushing to a size so fine that conventional gravimetric separations can not efficiently be used to wash the resultant product. Because of the deficiencies of conventional coal cleaning techniques and the ever increasing demand for coal with a higher heating value and a lower content of pyritic sulfur and other inorganic, ash-forming constituents, the need for improved methods of physically cleaning coal is readily apparent.

SUMMARY OF THE INVENTION

The present invention provides an improved process for the physical cleaning of coal and similar carbonaceous solids containing pyritic sulfur and other inorganic, ash-forming constituents. In accordance with the invention it has now been found that increased amounts of impurities in the form of inorganic, ash-forming constituents can be effectively removed from bituminous coal, subbituminous coal, lignite and similar carbonaceous solids of varying densities which contain such impurities by separating the carbonaceous solids into a high density fraction containing relatively large amounts of inorganic constituents and a low density fraction containing relatively small amounts of inorganic constituents, reducing the size of at least a portion of the particles comprising the low density fraction to produce smaller particles, separating the smaller particles into a low density fraction containing a relatively large amount of organic constituents and a high density fraction containing a relative small amount of organic constituents and recovering the low density fraction containing a relatively large amount of organic constituents as a product of clean carbonaceous solids. In general, the high density fraction produced in the initial separation step will contain particles having specific gravities greater than a value in the range from about 1.5 to about 1.9, preferably in the range from about 1.6 to about 1.8, while the particles comprising the low density fraction will have specific gravities less than a value in the range between about 1.3 and about 1.5, preferably in the range between about 1.3 and about 1.4. Normally, the carbonaceous solids fed to the process of the invention will be comprised of particles varying in size from about 3 inches to about 30 mesh on the U.S. Sieve Series Scale. The carbonaceous feed solids will preferably be raw coal particles ranging in size between about 3 inches and about ¼ inch on the U.S. Sieve Series Scale produced by crushing and screening run-of-mine coal.

In a preferred embodiment of the invention the initial low density fraction produced as described above is further separated into a lower density fraction and a middle density fraction prior to the size reduction step. The lower density fraction will normally be composed of particles having a specific gravities less than a value between about 1.3 and about 1.4. These particles are rich in organic constituents and can normally be directly recovered as very clean carbonaceous solids. The middle density fraction, which will normally be composed of particles having specific gravities in the range between about 1.4 and about 1.7, is then subjected to the size reduction step and the resultant particles separated into a high density fraction and a low density fraction that is recovered as a product of clean carbonaceous solids.

The process of the invention is based at least in part upon the discovery that when a coal fraction comprised of particles having specific gravities higher than a predetermined value is crushed and subjected to a gravimetric separation, the resulting low density fraction will be dirtier or contain a greater amount of inorganic constituents than a similar low density fraction produced by crushing a coal fraction comprised of cleaner particles having specific gravities lower than the predetermined value and subjecting the resultant particles to the same gravimetric separation. Thus, in a conventional coal cleaning process where the coal feed is crushed, the resultant particles are subjected to a gravimetric separation and the low density fraction is recovered as product, this low density fraction will contain more inorganic constituents than would be the case if the dirtier particles of high specific gravity in the original coal feed were removed prior to the crushing step. The process of the invention produces a cleaner product because the dirtier particles of high specific gravity are removed from the carbonaceous feed solids prior to the crushing step, which then operates on a lower density, cleaner fraction of coal.

The process of the invention provides a method for physically cleaning coal and similar carbonaceous solids which results in the removal of greater amounts of inorganic constituents from the raw coal than is normally possible by utilizing conventional coal cleaning techniques and therefore yields a product having a higher Btu content and a lower concentration of inorganic constituents. The process is also effective in achieving significant reductions in the pyritic sulfur content of the coal and therefore can be used to produce compliance coal that can normally be burned in conventional power plants not equipped with sophisticated scrubbing equipment without violating federal sulfur dioxide emission standards. Thus, the process of the invention can be used to provide a ready market for sulfur-containing coals that could not otherwise be directly burned thereby alleviating, to some extent, the ever increasing demand for the countries dwindling supplies of oil and gas.

BRIEF DESCRIPTION OF THE DRAWING

The drawing is a schematic flow diagram of a coal cleaning process carried out in accordance with the invention.

DESCRIPTION OF THE PREFERRED EMBODIMENTS

The process depicted in the drawing is one for the physical cleaning of a 3 inch by $\frac{3}{8}$ inch fraction of solid carbonaceous solids prepared by crushing and screening run-of-mine bituminous coal, subbituminous coal, lignite or similar carbonaceous solids containing pyritic sulfur and other inorganic ash-forming constituents. It will be understood that the feed to the coal cleaning process is not restricted to this particular size fraction of crushed run-of-mine coal and instead can be any size fraction of any carbonaceous material containing inorganic constituents and composed of particles of varying densities. The feed can be, for example, the residue from processes for the gasification of coal and similar feed solids, the liquefaction of coal and related carbonaceous material, the pyrolysis of coal and similar carbonaceous solids, the partial combustion of carbonaceous feed materials and the like. Such processes have been disclosed in the literature and will therefore be familiar to those skilled in the art.

In the process depicted in the drawing, the carbonaceous feed material in a size range between about 3 inches and about $\frac{3}{8}$ of an inch on the U.S. Sieve Series Scale is passed through line 10 into heavy medium washing vessel or similar device 12 where the particles are mixed with a heavy medium consisting of a sufficient amount of finely ground magnetite suspended in water to give a predetermined specific gravity which will normally range between about 1.5 and about 1.9, preferably between about 1.6 and 1.8 and will most preferably be about 1.7. The actual specific gravity utilized will normally depend upon the density variations in the solids fed to the washing vessel. The particles entering the vessel that have a specific gravity higher than the specific gravity of the aqueous magnetite suspension sink to the bottom of the vessel and the feed particles having a specific gravity lower than that of the suspension rise to the top of the vessel. The high density particles near the bottom of the vessel contain a relatively large amount of inorganic constituents and a relatively small amount of organic constituents and are therefore dirty, rock-like particles. These dirty particles are withdrawn from the bottom of vessel 12 through line 14 and may be used for landfill, further processed, or employed in other applications.

It will be understood that in lieu of the heavy medium washing vessel shown in the drawing, other vessels or similar equipment in which gravimetric separations can be carried out may be utilized depending upon the size fraction of the particles fed to the vessel. For example, if a fraction of relatively large particles is being processed, a jig may be used to effect the gravimetric separation. If an intermediate size fraction containing particles between about $\frac{1}{4}$ inch and about 30 mesh on the U.S. Sieve Series Scale is used, coal cleaning cyclones and concentrating tables may be used to effect the separation. Froth flotation cells are normally used to separate small particles that are less than about 30 mesh in size. Such pieces of equipment are described in the literature and will therefore be familiar to those of ordinary skill in the art.

In conventional coal cleaning processes, the coal fraction to be cleaned is normally crushed prior to washing in order to liberate pyritic sulfur and other inorganic ash-forming constituents from the original coal particles. While crushing to create particles of finer size will normally result in obtaining a cleaner coal product after washing, there are limitations on the amount of inorganic constituents that can be removed in this manner. The finer the coal is ground, the more difficult it is to separate the resultant particles and at some degree of fineness such a separation will become impractical from both an economic and physical point of view. It has now been found that a cleaner coal product can be produced without crushing the coal to such a fine size by first subjecting the coal to a gravimetric separation to remove the dirtier, higher density particles and then selectively crushing the cleaner, lower density particles. The low density fraction of particles obtained by washing the crushed solids will be cleaner than a similar fraction obtained from a conventional process which does not utilize such a separation prior to crushing.

The process of the invention is based at least in part upon the discovery that if a fraction of relatively dirty, high density particles is crushed and subsequently washed by means of a gravimetric separation, the resultant low density fraction is dirtier than a low density fraction obtained by crushing a cleaner fraction of coal and subjecting it to a gravimetric separation at the same specific gravity. Thus, when a fraction of run-of-mine coal containing relatively dirty and relatively clean particles is crushed, the smaller, low density particles that are produced by crushing the relatively dirty particles will be dirtier than the smaller, low density particles produced by crushing the relatively clean particles. Since some of these low density particles will be in the same specific gravity range, they will commingle with one another when the crushed coal is separated into a low density and high density fraction. This commingling of dirtier low density particles with cleaner low density particles is avoided by initially rejecting the dirty, high density particles from the coal feed prior to crushing.

Referring again to the drawing, the cleaner, low density fraction of carbonaceous solids produced in washing vessel 12 by removing the dirtier, higher density particles is withdrawn and passed through line 16 into a second heavy medium washing vessel 18 where the particles are subjected to another gravimetric separation at a specific gravity less than that utilized in washing vessel 12. Normally, the specific gravity in washing vessel 18 will range between about 1.3 and about 1.5, preferably between about 1.3 and 1.4. The low density particles that float to the top of washing vessel 18 will contain relatively large amounts of carbonaceous material and relatively small amounts of pyritic sulfur and other inorganic impurities. These particles are withdrawn from the washing vessel through line 20 and because of their high Btu heating value and low sulfur content are suitable for direct use as fuel in furnaces, steam generators and similar equipment. The high density particles that settle to the bottom of washing vessel 18 are removed from the vessel through line 22. These particles contain relatively large amounts of inorganic constituents and must be further treated to remove at least a portion of these impurities.

The dirty, high density particles in line 22 are passed to rotary crusher or similar fragmenting device 24 where the particles are ground, crushed or otherwise reduced in size to liberate the inorganic constituents from the organic, carbonaceous material. The greater the degree of crushing or grinding the more of the inorganic constituents that are liberated. It is, however, undesirable to crush or grind to very small particle sizes since this requires a relatively large input of energy and makes the subsequent separation difficult to achieve. The actual size of the particles produced in the rotary crusher is determined in part by balancing the cost of the crushing with the amount of inorganic constituents liberated and the fineness of the resultant product.

The crushed solids removed from rotary crusher 24 will normally have a top size between about 1 inch and about ¼ inch and are passed through line 26 to vibrating screen or similar size separation device 28 where the fine particles, normally those below about 30 mesh in size, are separated from the coarser particles. The fine particles are passed through line 30 to a froth flotation cell or similar device, not shown in drawing, where the clean particles are separated from the dirty particles. The clean particles may be combined with the particles in line 20 and used directly as fuel for furnaces, power plants and the like.

The coarse fraction of particles produced by separation in vibrating screen 28 is passed through line 32 to heavy medium cleaning cyclone 34 where the particles are subjected to a gravimetric separation to separate the liberated particles containing relatively large amounts of inorganic constituents from the clean, carbonaceous solids. The specific gravity of the aqueous magnetite suspension used as the heavy medium in cyclone 34 will normally range between about 1.5 and about 1.9 and will preferably be about equal to the specific gravity of the suspension used in washing vessel 12. The heavy weight particles that are forced to the bottom of cyclone 34 are withdrawn through line 36 and disposed of as landfill, further processed, or used for other purposes. The carbonaceous solids that rise to the top of the vessel contain relatively small amounts of pyritic sulfur and other inorganic impurities. These carbonaceous solids, which possess a high Btu heating value, a low sulfur content and comprise the major portion of the clean coal product produced by the process of the invention, are removed from the vessel through line 38 and may be combined with the solids removed from washing vessel 18 through line 20 and used for direct burning as fuel in furnaces, steam generators, and similar energy producing devices.

In the embodiment of the invention shown in the drawing and described above, the carbonaceous feed solids are subjected to a first gravimetric separation in washing vessel 12 at a relatively high specific gravity and a second gravimetric separation in washing vessel 18 at a lower specific gravity. The purpose of these separations is to divide the coal feed into three weight fractions: a low density fraction in line 20 which is normally recovered as clean coal, a high density fraction in line 14 which is normally rejected as waste and a middle density fraction in line 22 which is crushed to liberate inorganic impurities. It will be understood that this embodiment of the invention is not limited to this particular configuration for producing the three fractions of different densities. For example, it may be desirable to use a lower specific gravity in the first vessel than in the second washing vessel. If such is the case, the low density fraction is recovered from the top of vessel 12, the bottoms from the vessel is fed to vessel 18, the bottoms from vessel 18 is rejected as the high density, waste fraction and the overhead from vessel 18 comprises the middle density fraction that is subjected to crushing. In this configuration of the invention, the specific gravity in the first washing vessel will normally be between about 1.3 and about 1.5 and the specific gravity in the second washing vessel will normally range from about 1.6 to about 1.9. Alternatively, a single washing vessel containing two magnetite suspensions or other fluid media of different specific gravities, or a cleaning device such as a concentrating table can be use to produce the three weight fractions in a single step.

It will be further understood that the process of the invention is not limited to the embodiment where the carbonaceous feed is divided into three weight fractions and the middle density fraction is crushed and washed. The process of the invention is equally applicable to the case where the carbonaceous feed is subjected to a single separation and the resultant low density fraction is crushed and washed. In addition, the process of the invention is applicable to the situation where more than two separations are utlized prior to the crushing and washing steps.

The nature and objects of the invention are further illustrated by the results of laboratory tests which indicate that a cleaner coal product can be produced from a coal fraction by first removing the dirtier, higher density particles from the coal fraction, crushing the remainder of the fraction and then subjecting the resultant particles to a gravimetric separation.

A fraction of raw crushed bituminous coal containing particles ranging in size from 3 inches to ⅜ of an inch on the U.S. Sieve Series Scale was divided by means of a riffle into two representative portions. In run 1, the first portion was crushed to produce smaller particles which were then screened to separate the particles into a ⅜ inch by 30 mesh size fraction and a 30 mesh by 0 size fraction. The ⅜ inch by 30 mesh fraction of particles was then washed by placing it in a beaker containing a homogeneous mixture of hydrocarbon liquids having a specific gravity of about 1.7 and the resultant slurry was agitated. The particles that floated to the top of the liquid in the beaker were removed, dried, weighed and analyzed for ash content, Btu content and sulfur content. The amount of sulfur dioxide that would be given off during burning was then calculated. In run 2, the second portion of the 3 inch by ⅜ inch raw coal fraction, unlike the first portion, was washed prior to the crushing step to remove the higher density inorganic-rich particles. This wash was conducted by slurrying the particles in a homogeneous mixture of hydrocarbon liquids having a specific gravity of about 1.7. The lower density material which floated to the top of the mixture of liquids was removed and crushed. The resultant particles were separated by screening into two size fractions, a ⅜ inch by 30 mesh fraction and a 30 mesh by 0 fraction. The ⅜ by 30 mesh size fraction was then washed by placing it in a beaker containing a mixture of hydrocarbon liquids having a specific gravity of 1.7 and the lighter particles that rose to the top of the beaker were removed, dried, weighed and analyzed as in the previous run. The results of these tests are set forth in Table I below.

TABLE I

| | Run 1 No Wash Prior To Crushing | Run 2 Wash Prior To Crushing |
|---|---|---|
| Amount of ⅜" × 30 mesh particles that floated (wt. %) | 69 | 94 |
| Ash (wt. %) | 9.1 | 7.7 |
| Total sulfur (wt. %) | .85 | .71 |
| Pyritic sulfur (wt. %) | .15 | .12 |
| Heating value (Btu/lb.) | 13,446 | 13,634 |
| $SO_2$ emitted (lbs/MBtu) | 1.26 | 1.04 |

It can be seen from Table I that the ⅜ inch by 30 mesh fraction of coal recovered in run 2 contains less ash, less total sulfur, less pyritic sulfur and more Btu's than the fraction obtained in run 1. Furthermore, the calculated amount of sulfur dioxide emissions is significantly less for both the fraction recovered in run 2 and the standard for a compliance coal of 1.2 pounds per million Btu. Thus, the data in Table I clearly indicate that a cleaner coal product can be obtained from a fraction of coal be removing the dirtier, higher density particles, which contain relatively large amounts of inorganic impurities, prior to crushing and washing the coal as is done in conventional coal cleaning plants.

It will be apparent from the foregoing that the process of the invention provides an improved physical coal cleaning process which makes it possible to obtain coal with lesser amounts of pyritic sulfur and other inorganic ash-forming constituents than was heretofore possible. As a result, it is possible to utilize more coal directly as a fuel without the necessity of employing expensive scrubbing technology to remove sulfur dioxide from the combustion gases.

I claim:

1. A process for cleaning carbonaceous solids of varying densities which contain inorganic, ash-forming constituents comprising:

(a) removing from said carbonaceous solids substantially all particles having a specific gravity greater than a predetermined value thereby producing a fraction of solids comprised of particles having a specific gravity less than said predetermined value;

(b) crushing or grinding substantially all of said particles having a specific gravity less than said predetermined value to produce smaller particles;

(c) separating said smaller particles into a high density fraction and a low density fraction; and (d) recovering said low density fraction produced in step (c) as clean carbonaceous solids.

2. A process as defined in claim 1 wherein said carbonaceous solids comprise coal particles of varying densities.

3. A process as defined in claim 1 wherein said carbonaceous solids are comprised of particles within a size range between about 3 inches and about ¼ inch on the U.S. Sieve Series Scale.

4. A process as defined in claim 1 wherein steps (a) and (c) comprise gravimetric separations carried out in a liquid medium.

5. A process as defined in claim 1 wherein step (a) is a gravimetric separation carried out in a liquid medium at a specific gravity in the range between about 1.5 and about 1.9.

6. A process as defined in claim 1 wherein particles having specific gravities less than a predetermined value in the range between about 1.3 and about 1.5 are removed from said carbonaceous solids prior to step (a) and recovered as clean carbonaceous solids.

7. A process as defined in claim 1 wherein said particles having a specific gravity less than said predetermined value have a top size greater than ¼ inch.

8. A process as defined in claim 1 wherein step (a) is carried out in a heavy medium washing vessel.

9. A process as defined by claim 1 wherein said particles having a specific gravity less than said predetermined value are crushed or ground to smaller particles having a top size between about 1 inch and about ¼ inch.

10. A process as defined by claim 1 wherein step (a) comprises a gravimetric separation.

11. A process for cleaning carbonaceous solids of varying densities which contain inorganic, ash-forming constituents comprising:

(a) subjecting said carbonaceous solids to a gravimetric separation in a liquid medium at a predetermined specific gravity to divide said solids into a high density fraction and a lighter density fraction;

(b) subjecting substantially all of said lighter density fraction to a gravimetric separation in a liquid medium at a specific gravity less than said predetermined specific gravity to divide said lighter density fraction into a low density fraction and a middle density fraction;

(c) crushing or grinding the particles comprising said middle density fraction to produce smaller particles;

(d) subjecting said smaller particles to a gravimetric separation in a liquid medium at a specific gravity greater than said specific gravity used in step (b); and (e) recovering the portion of said smaller particles in the overhead from the gravimetric separation in step (d) as clean carbonaceous solids.

12. A process for cleaning coal solids which comprises:

(a) subjecting said coal solids to a gravimetric separation carried out in a liquid medium at a specific gravity between about 1.5 and about 1.9, thereby separating said coal solids into a first low density fraction and a first high density fraction;

(b) subjecting substantially all of said first low density fraction to a gravimetric separation carried out in a liquid medium at a specific gravity between about 1.3 and about 1.5, thereby producing a second low density fraction and a second high density fraction;

(c) crushing said second high density fraction into smaller particles;

(d) subjecting at least a portion of said smaller particles produced in step (c) to a gravimetric separation carried out in a liquid medium at a specific gravity between about 1.5 and about 1.9, thereby producing a third low density fraction and a third high density fraction; and (e) recovering said third low density fraction as clean coal product.

13. A process as defined in claim 11 wherein the gravimetric separation of step (a) is carried out at a specific gravity between about 1.6 and about 1.8, the gravimetric separation of step (b) is carried out at a specific gravity between about 1.3 and about 1.4, and the gravimetric separation of step (d) is carried out at about the same specific gravity utilized in step (a).

14. A process for cleaning carbonaceous solids of varying densities which contain inorganic, ash-forming constituents comprising:

(a) subjecting said carbonaceous solids to a gravimetric separation in a liquid medium at a predetermined specific gravity to divide said solids into a low density fraction and a heavier density fraction;

(b) subjecting said heavier density fraction to a gravimetric separation in a liquid medium at a specific gravity greater than said predetermined specific gravity to divide said heavier density fraction into a high density fraction and a middle density fraction;

(c) crushing or grinding the particles comprising said middle density fraction to produce smaller particles;

(d) subjecting said smaller particles to a gravimetric separation in a liquid medium at a specific gravity greater than said predetermined specific gravity used in step (a); and (e) recovering the portion of said smaller particles in the overhead from the gravimetric separation in step (d) as clean carbonaceous solids.

* * * * *